US007056874B2

(12) United States Patent
Tadrowski et al.

(10) Patent No.: US 7,056,874 B2
(45) Date of Patent: Jun. 6, 2006

(54) CLEANING SOLUTIONS FOR CARBON REMOVAL

(75) Inventors: Tami J. Tadrowski, Greensboro, NC (US); Jennifer Mayhall, Belews Creek, NC (US); Kim R. Smith, Woodbury, MN (US)

(73) Assignee: Ecolab Inc., St. Paul, MN (US)

( * ) Notice: Subject to any disclaimer, the term of this patent is extended or adjusted under 35 U.S.C. 154(b) by 305 days.

(21) Appl. No.: 10/659,806

(22) Filed: Sep. 11, 2003

(65) Prior Publication Data

US 2004/0058839 A1 Mar. 25, 2004

Related U.S. Application Data

(60) Provisional application No. 60/413,213, filed on Sep. 23, 2002.

(51) Int. Cl.

| | |
|---|---|
| ***C11D 1/66*** | (2006.01) |
| ***C11D 3/10*** | (2006.01) |
| ***C11D 3/43*** | (2006.01) |
| ***C11D 3/37*** | (2006.01) |
| ***B08B 3/04*** | (2006.01) |

(52) U.S. Cl. ..... 510/197; 510/421; 510/432; 510/433; 510/434; 510/476; 510/505; 134/25.2; 134/25.3; 134/39; 134/40; 134/42

(58) Field of Classification Search ..... 510/197, 510/421, 432, 433, 434, 476, 505; 134/25.2, 134/25.3, 39, 40, 42

See application file for complete search history.

(56) References Cited

U.S. PATENT DOCUMENTS

| | | | | |
|---|---|---|---|---|
| 4,289,640 | A | 9/1981 | Falivene | |
| 4,303,543 | A | 12/1981 | Mansy | |
| 4,415,488 | A | 11/1983 | Blaschke et al. | |
| 5,039,349 | A | 8/1991 | Schoeppel | |
| 5,552,079 | A | 9/1996 | Roach et al. | |
| 5,583,265 | A | 12/1996 | Woo et al. | |
| 5,634,984 | A | 6/1997 | Van Slyke | |
| 5,713,384 | A | 2/1998 | Roach et al. | |
| 5,723,423 | A | 3/1998 | Van Slyke | |
| 5,780,407 | A | 7/1998 | Van Slyke | |
| 5,788,781 | A | 8/1998 | Van Slyke | |
| 5,863,887 | A | 1/1999 | Gillette | |
| 5,866,532 | A | 2/1999 | Jackson et al. | |
| 5,919,312 | A | 7/1999 | Wierenga et al. | |
| 5,924,460 | A | 7/1999 | Jones | |
| 5,972,866 | A | 10/1999 | Ahmed | |
| 6,051,541 | A | 4/2000 | Neuser et al. | |
| 6,117,831 | A | 9/2000 | Chiang et al. | |
| 6,156,716 | A * | 12/2000 | Ahmed | 510/272 |
| 6,291,418 | B1 | 9/2001 | Mertens et al. | |

FOREIGN PATENT DOCUMENTS

| | | |
|---|---|---|
| EP | 0 015 032 | 9/1980 |
| EP | 0 743 360 | 11/1996 |
| EP | 743360 | * 11/1996 |
| WO | WO 95/31523 | 11/1995 |

* cited by examiner

*Primary Examiner*—Brian P. Mruk
(74) *Attorney, Agent, or Firm*—Andrew D. Sorensen; Anneliese S. Mayer

(57) ABSTRACT

Cleaning compositions are disclosed. Methods of making and using the cleaning compositions are also disclosed.

27 Claims, No Drawings

CLEANING SOLUTIONS FOR CARBON REMOVAL

CROSS-REFERENCE TO RELATED APPLICATIONS

This patent application claims the benefit of priority to U.S. provisional patent application Ser. No. 60/413,213, filed on Sep. 23, 2002, which is incorporated herein in its entirety.

FIELD OF THE INVENTION

The present invention relates to cleaning compositions, which may be used to clean grills, toasters, and other cooking surfaces.

BACKGROUND OF THE INVENTION

Liquid grill-cleaning products are used in a number of residential and commercial applications. For example, in the fast food industry, grill cleaners, such as SIZZLE PLUS Grill Cleaner and SIZZLE Grill Cleaner (available from Kay Chemicals, Inc., Greensboro, N.C.) are used to clean grills and toasters having at least one flat, continuous metal surface. Typically, a user applies a liquid cleaning product onto a surface of the grill or toaster while the grill or toaster surface is still hot, usually above 148.9° C. (300° F.) and up to 262.8° C. (505° F.). Conventional grill-cleaning products have one or more shortcomings. Such shortcomings include, but are not limited to, unstable performance at temperatures up to 262.8° C. (505° F.); splattering at temperatures up to 262.8° C. (505° F.); generation of smoke; generation of a residue at high temperatures, such as 262.8° C. (505° F.); an undesirable viscosity, which results in inadequate coverage of the grill or toaster surface; and inadequate cleaning capacity at temperatures less than about 148.9° C. (300° F.), especially at room temperature (22° C., 75° F.).

What is needed in the art are grill or toaster cleaning products for use in residential, commercial, and industrial applications. Further, what is needed in the art are liquid cleaning products that have one or more of the following properties: (1) is stable up to a temperature of 262.8° C. (505° F.); (2) displays a minimum amount of splattering up to 262.8° C. (505° F.); (3) generates a minimal amount of smoke; (4) leaves essentially no residue up to a temperature of 262.8° C. (505° F.); and (5) provides exceptional cleaning capacity at temperatures less than about 148.9° C. (300° F.), even at room temperature (22° C., 75° F.).

SUMMARY OF THE INVENTION

The present invention addresses some of the difficulties and problems discussed above by the discovery of cleaning solutions having a unique combination of components, which results in cleaning solutions having a desired utility up to a temperature of 262.8° C. (505° F.). The cleaning solutions find particular utility as grill and toaster cleaners, such as those commonly used in the fast-food industry. In one embodiment of the present invention, the cleaning solutions may be used to clean heated surfaces up to a temperature of 262.8° C. (505° F.) without leaving an undesirable residue or generating an undesirable degree of smoke and splattering. In a further embodiment of the present invention, the cleaning solutions may be used to clean surfaces at room temperature.

Accordingly, the present invention is directed to cleaning solutions comprising a combination of components, which results in cleaning solutions having one or more desired properties including, but not limited to, cleaning solution stability up to a temperature of about 262.8° C. (505° F.); a minimal amount of splattering at temperatures of up to about 262.8° C. (505° F.); a minimal amount of smoke generation at temperatures of up to about 262.8° C. (505° F.); a minimal amount of residue formation at temperatures up to about 262.8° C. (505° F.); and exceptional cleaning capacity at temperatures as low as room temperature (22° C., 75° F.).

The present invention is also directed to methods of making cleaning solutions, and methods of using the cleaning solutions on heated or room temperature surfaces, such as grill or toaster surfaces.

These and other features and advantages of the present invention will become apparent after a review of the following detailed description of the disclosed embodiments and the appended claims.

DETAILED DESCRIPTION OF THE INVENTION

To promote an understanding of the principles of the present invention, descriptions of specific embodiments of the invention follow and specific language is used to describe the specific embodiments. It will nevertheless be understood that no limitation of the scope of the present invention is intended by the use of specific language. Alterations, further modifications, and such further applications of the principles of the present invention discussed are contemplated as would normally occur to one ordinarily skilled in the art to which the invention pertains.

The present invention is directed to a combination of ingredients, and those skilled in the art may find ways to alter that combination by means of further chemical additions to the solution specifically disclosed and claimed. Moreover, the amounts set out in embodiments and even the claims may be changed and still achieve the benefits of the present invention. Such modifications are considered to be within the scope of the present invention, as set out in the attached claims and their equivalents.

The present invention is directed to liquid cleaning solutions having a unique combination of components, which results in cleaning solutions having desired properties for cleaning applications at temperatures up to about 262.8° C. (505° F.). The liquid cleaning solutions contain a balanced combination of surfactants, viscosity control agents, and thickeners in order to produce desired cleaning properties at high temperature.

I. Liquid Cleaning Solution Components

The liquid cleaning solutions of the present invention comprise a number of components, which provide desired characteristics to the resulting liquid cleaning solutions. A description of each class of liquid cleaning solution component is given below.

A. Water

The liquid cleaning solutions of the present invention comprise water as a primary solvent or carrier. Soft or hard water may be used in the present invention, although soft water is more desirable. As used herein, the term "soft water" refers to water containing less than about 60 ppm of calcium carbonate. As used herein, the term "hard water" refers to water containing more than about 60 ppm of calcium carbonate, while "very hard water" refers to water containing more than about 180 ppm of calcium carbonate.

The liquid cleaning solutions of the present invention may be formed using water available from any municipal water-treatment facility.

The liquid cleaning solutions of the present invention typically comprise up to about 90 weight-percent (wt %) of water based on a total weight of the liquid cleaning solution. Desirably, the liquid cleaning solutions of the present invention comprise from about 3 to about 80 wt % water based on a total weight of the liquid cleaning solution. More desirably, the liquid cleaning solutions of the present invention comprise from about 15 to about 55 wt % water based on a total weight of the liquid cleaning solution.

B. Surfactants

The liquid cleaning solutions of the present invention comprise one or more surfactants. Suitable surfactants for use in the present invention include, but are not limited to, natural surfactants (i.e., surfactants based on natural components such as fatty acids, coconut oil, etc.), anionic surfactants, cationic surfactants, nonionic surfactants, and amphoteric surfactants. Natural surfactants include, but are not limited to, coconut-based soap solutions. Anionic surfactants include, but are not limited to, dodecyl benzene sulfonic acid and its salts, alkyl ether sulfates and salts thereof, olefin sulfonates, phosphate esters, soaps, sulfosuccinates, and alkylaryl sulfonates. Cationic surfactants include, but are not limited to, alkoxylated cationic ammonium surfactants. Nonionic surfactants include, but are not limited to, alkoxylates of alkyl phenols and alcohols, alkanolamides, and alkyl polyglycocides. Amphoteric surfactants include, but are not limited to, imidazoline derivatives, betaines, and amine oxides.

Desirably, the liquid cleaning solution of the present invention comprises one or more surfactants including, but are not limited to, coconut-based soap solutions, ethoxylated alcohols containing from about 6 to about 24 carbon atoms and as many as 12 ethoxylate groups, propoxylated quat (i.e., quaternary surfactants), and combinations thereof. In one desired embodiment of the present invention, the liquid cleaning solution comprises a coconut-based soap solution. In a further embodiment of the present invention, the liquid cleaning solution comprises a combination of surfactants, wherein the combination comprises two or more ethoxylated alcohols wherein each alcohol has from about 10 to about 16 carbon atoms and up to about 8 ethoxylate groups.

The one or more surfactants may be present in an amount of up to about 80 wt % based on a total weight of the liquid cleaning solution. Desirably, the one or more surfactants are present in an amount ranging from about 0.1 to about 50.0 wt % based on a total weight of the liquid cleaning solution. More desirably, the one or more surfactants are present in an amount ranging from about 0.5 to about 30.0 wt % based on a total weight of the liquid cleaning solution.

A number of commercially available surfactants may be used in the present invention. Suitable commercially available coconut-based soap solution surfactants include, but are not limited to, coconut-based soap solution (30%) available from Kay Chemical Company (Greensboro, N.C.); ammonium cocoate available from Chemron Corporation (Paso Robles, Calif.); Carroll 40% coconut soap available from Carroll Company (Garland, Tex.); and potassium cocoate available from Chemron Corporation (Paso Robles, Calif.). Suitable commercially available ethoxylated alcohols having from about 10 to about 16 carbon atoms and up to about 8 ethoxylate groups include, but are not limited to, surfactants sold under the trade designation SURFONIC®, available from Huntsman Chemical Company (Houston, Tex.), such as SURFONIC® 24-3; and surfactants sold under the trade designation TERGITOL™, available from Dow Chemical Company (Midland, Minn.), such as TERGITOL™15-S-7. Suitable commercially available alkoxylated cationic ammonium surfactants include, but are not limited to, surfactants sold under the trade designation GLENSURF™, available from the Glenn Chemical Company (St. Paul, Minn.), such as GLENSURF™42; surfactants sold under the trade designation VARIQUAT™, available from the DeGussa Chemical Company (Parsippany, N.J.), such as VARIQUAT™ CC-42NS; and surfactants sold under the trade designation EMCOL™, available from Witco Corporation (Greenwich, Conn.), such as EMCOL™ CC-9, EMCOL™ CC-36, and EMCOL™ CC42.

C. Builders

The liquid cleaning solutions of the present invention may comprise one or more builders. Suitable builders for use in the present invention include, but are not limited to, organic compounds, inorganic compounds, or a combination thereof. Desirably, the builders are organic. Nonlimiting examples of organic builders include the salts or acid form of nitriloacetic acid and its derivatives, amino carboxylates, organic phosphonates, amides, polycarboxylates, salicylates and their derivatives, sodium aluminosilicates, zeolites, and derivatives of polyamino compounds or mixtures thereof. Nonlimiting examples of nitriloacetic acid derivatives include sodium nitriloacetate, and magnesium nitriloacetate. Nonlimiting examples of amino carboxylates include sodium iminosuccinates. Nonlimiting examples of organic phosphonates include amino tri(methylene phosphonate), hydroxyethylidene diphosphonate, diethylenetriamine penta-(methylenephosphonate), and ethylenediamine tetra (methylene-phosphonate). Nonlimiting examples of polycarboxylates include citric acid and it salts and derivatives, sodium glutarate, potassium succinate, polyacrylic acid and its salts and derivatives and copolymers. Nonlimiting examples of polyamino compounds include ethylene diamine (EDTA), diethyltriaminepentaacetic acid (DTPA), hydroxyethylene diamine, and their salts and derivatives. Nonlimiting examples of inorganic builders include sodium tripolyphosphate, sodium carbonate, sodium pyrophosphate, potassium pyrophosphate, magnesium phosphate, tetramethylammonium phosphate, potassium carbonate and sodium phosphate.

In one desired embodiment of the present invention, the liquid cleaning solution comprises at least one builder selected from polyacrylates or their copolymers, iminodisuccinate, citrate, ethylenediamine or triamine derivatives, or mixtures thereof.

The one or more builders may be present in an amount of up to about 60 wt % based on a total weight of the liquid cleaning solution. Desirably, when present, the one or more builders are present in an amount ranging from about 10.0 to about 40.0 wt % based on a total weight of the liquid cleaning solution. More desirably, when present, the one or more builders are present in an amount ranging from about 20.0 to about 30.0 wt % based on a total weight of the liquid cleaning solution.

A number of commercially available builders may be used in the present invention. Suitable commercially available builders include, but are not limited to, sodium iminodisuccinate sold under the trade designation BAYPURE®, available from Bayer Corporation (Baytown, Tex.), such as BAYPURE® CX100.

D. Solvents

The liquid cleaning solutions of the present invention may include one or more solvents. Suitable solvents for use in the present invention include, but are not limited to, glycols, alcohols, glycol ethers, esters, and combinations thereof. Suitable glycols include, but are not limited to, triethylene glycol (TEG), glycerin, diethylene glycol, ethylene glycol, propylene glycol, dipropylene glycol, and hexylene glycol. Suitable alcohols include, but are not limited to, isopropanol, ethanol, and benzyl alcohol.

The one or more solvents may be present in the liquid cleaning solutions of the present invention in an amount of up to about 95 wt % based on a total weight of the liquid cleaning solution. Desirably, when present, the liquid cleaning solutions of the present invention comprise one or more solvents in an amount of from about 10 to about 75 wt % based on a total weight of the liquid cleaning solution.

In one desired embodiment of the present invention, the liquid cleaning solution comprises glycerin in an amount ranging from about 13 to about 75 wt %, more desirably about 40 to about 68 wt % based on a total weight of the liquid cleaning solution. In a further embodiment of the present invention, the liquid cleaning solution comprises TEG in an amount ranging from about 0 to about 75 wt %, more desirably about 0 to about 35 wt %, and even more desirably about 0 to about 15 wt % based on a total weight of the liquid cleaning solution. In yet a further embodiment of the present invention, the liquid cleaning solution comprises a combination of glycerin and TEG in an amount of up to about 75 wt % of combined glycerin and TEG, more desirably about 45 to about 75 wt % of combined glycerin and TEG, and even more desirably about 50 to about 65 wt % of combined glycerin and TEG based on a total weight of the liquid cleaning solution.

Commercially available glycols suitable for use in the present invention glycols may be obtained from a variety of vendors including, but not limited to, Lonza, Inc. (Fairlawn, N.J.) and Equistar (Dallas, Tex.).

E. pH Control Agents

The liquid cleaning solutions of the present invention may contain one or more pH control agents. The pH of the liquid cleaning solution may range from about 0 to about 14. In one desired embodiment of the present invention, the pH of the liquid cleaning solution is from about 7 to about 13, more desirably, from about 8 to about 13, and even more desirably, about 10 to about 12.5. Typically, when present, the one or more pH control agents are present in an amount of up to about 20 wt % based on a total weight of the liquid cleaning solution.

Suitable pH control agents include, but are not limited to, inorganic acidic compounds including sodium hydrogen sulfate, calcium phosphate and hydrogen phosphate; organic acid compounds including carboxylic acids such as oxalic acid, and polyacrylic acid; inorganic alkaline compounds including hydroxides, silicates, and carbonates; and organic alkaline compounds including amines and alkoxides. In one desired embodiment of the present invention, the liquid cleaning solution contain a pH control agent comprising a potassium carbonate 47% liquid solution (i.e., 47 wt % potassium carbonate in water) available from Ashta Chemicals (Ashtabula, Ohio).

F. Viscosity Control Agents

The liquid cleaning solutions of the present invention may include one or more viscosity control agents (i.e., thickeners) in an amount of up to about 10.0 wt % based on a total weight of the liquid cleaning solution. Suitable viscosity control agents include, but are not limited to, xanthan gum thickeners, acrylic polymers, alkanolamides, alkanolamines, inorganic bases and acids, cellulosic polymers, and combinations thereof.

In one desired embodiment of the present invention, the liquid cleaning solution comprises a xanthan gum thickener in an amount ranging from about 0.01 to about 1.0 wt % based on a total weight of the liquid cleaning solution. In a further embodiment of the present invention, the liquid cleaning solution comprises from about 0.1 to about 0.5 wt % of one or more xanthan gum thickeners based on a total weight of the liquid cleaning solution.

In yet a further embodiment of the present invention, the liquid cleaning solution comprises one or more acrylic polymers in an amount ranging from about 0.01 to about 10.0 wt % based on a total weight of the liquid cleaning solution. In a further embodiment of the present invention, the liquid cleaning solution comprises from about 2.0 to about 8.0 wt %, desirably, from about 2.0 to about 6.0 wt % of one or more acrylic polymers based on a total weight of the liquid cleaning solution.

Commercially available viscosity control agents suitable for use in the present invention include, but are not limited to, xanthan gum thickeners sold under the trade designation KELTROL™ available from CP Kelco (Wilmington, Del.), such as the KELTROL™ and KELTROL™ HP products. Suitable commercially available acrylic polymers for use in the present invention include, but are not limited to, acrylic polymers sold under the trade designation ACUSOL®, available from Rolm and Haas (Glen Allen, Va.), such as ACUSOL® 820.

G. Foam-Control Agents

The liquid cleaning solutions of the present invention may also contain one or more foam-control agents. Suitable foam-control agents include, but are not limited to, silicones such as polydimethyl siloxanes and perfluorinated acids.

The liquid cleaning solutions may comprise one or more foam-control agents, typically in an amount of up to about 2.5 wt % based on a total weight of the liquid cleaning solution. In one embodiment of the present invention, the liquid cleaning solution comprises from about 0.01 to about 2.0 wt % of one or more foam-control agents, based on a total weight of the liquid cleaning solution. When the foam-control agent is present in the form of a solution, the active ingredient (e.g., the silicone component) is typically present in an amount ranging from about 1.0 to about 20.0 wt % based on a total weight of the foam-control agent solution. Consequently, the amount of active foam-control agent is typically present in the liquid cleaning solution in an amount ranging from about 0.0001 to about 0.40 wt % based on a total weight of the liquid cleaning solution, more typically, about 0.01 to about 0.15 wt % based on a total weight of the liquid cleaning solution.

Commercially available foam-control agents suitable for use in the present invention include, but are not limited to, foam control agents sold under the trade designation PI-35, available from Ultra Additives, Inc. (Paterson, N.J.).

H. Other Additives

The liquid cleaning solutions of the present invention may contain one or more additives to provide a desired characteristic to the solution. Suitable additives include, but are not limited to, dyes, pigments, perfumes, preservatives, antimicrobial agents, hydrotropes, corrosion inhibitors, bleaching agents, bleach activators, abrasives, anti-redeposition agents, softeners, conditioners, wetting modification agents, and combinations thereof. In one desired embodiment of the present invention, the liquid cleaning solution comprises at least one dye to provide a desirable color.

Typically, additives, such as those mentioned above, are each individually present in an amount of less than about 2.0 wt % based on a total weight of the liquid cleaning solution.

Desirably, each additive, when present, is individually present in an amount ranging from about greater than zero (≧0) to about 0.5 wt % based on a total weight of the liquid cleaning solution.

A number of commercially available additives may be used in the present invention. Commercially available dyes suitable for use in the present invention include, but are not limited to, Yellow Dye FD&C#5 available from Pylam Products (Tempe, Ariz.); Blue Pylaklor LX 10092 available from Pylam Products (Tempe, Ariz.); Resorcine Brown 5GM available from Pylam Products (Tempe, Ariz.); and Tartrazine Yellow available from Chemcentral (Romulus, Mich.). Commercially available perfumes suitable for use in the present invention include, but are not limited to, perfume SZ-6929 (Apple) available from J. E. Sozio, Inc. (Edison, N.J.); Citrus SZ 6242 available from J. E. Sozio, Inc. (Edison, N.J.); and MF 3773 (lemon) available from Mane, USA (Wayne, N.J.). Commercially available preservatives suitable for use in the present invention include, but are not limited to, preservatives sold under the trade designation UCARCIDE™, available from (Union Carbide Corp., Danbury, Conn.), such as UCARCIDE™ 250.

II. Methods of Making Liquid Cleaning Solutions

The liquid cleaning solutions of the present invention may be prepared using conventional mixing techniques. The components for forming the liquid cleaning solutions may be combined with water in any order at room temperature. Typically, liquid cleaning solutions are prepared by combining the components in the following order while mixing: water, one or more viscosity modifiers (when present), one or more solvents (when present), one or more surfactants, one or more pH control agents (when present), and one or more additives (when present).

In one desired embodiment of the present invention, a liquid cleaning solution is prepared using the following steps:

(1) forming a premix by adding water to a first mix tank equipped with a stirrer after making sure that the first mix tank is clean;
(2) stirring the water at a speed sufficient to form a vortex in the water;
(3) adding xanthan gum to the water while mixing;
(4) letting the mixture stir for about 1 hour or until the mixture is uniform;
(5) sampling the mixture to determine whether the xanthan gum has dissolved in the water and continuing to mix for about 30 minutes if needed to completely dissolve the xanthan gum;
(6) forming a main mixture by adding glycerine to a second mix tank equipped with a stirrer after making sure that the second mix tank is clean;
(7) pumping the premix into the second mix tank;
(8) adding coconut soap surfactant to the second mix tank;
(9) adding potassium carbonate to the second mix tank;
(10) adding dye to the second mix tank and mixing the mixture for about 15 minutes; and
(11) sampling the mixture to test for desired mixture properties.

In a further desired embodiment of the present invention, a liquid cleaning solution is prepared using the following steps:

(1) adding water to a mix tank equipped with a stirrer after making sure that the mix tank is clean;
(2) stirring the water at a speed sufficient to form a vortex in the water;
(3) adding one or more solvents, such as a mixture of TEG and glycerine, to the water while mixing;
(4) adding an acrylic polymer viscosity modifier to the mixture;
(5) adding a pH control agent, such as potassium carbonate, to the mixture;
(6) adding one or more surfactants, such as coconut soap surfactant, to the mixture;
(7) adding dye to the mixture and stirring for about 15 minutes; and
(8) sampling the mixture to test for desired mixture properties.

The resulting liquid cleaning solutions typically have a solution viscosity ranging from about 1 cps to about 5000 cps. Desirably, the liquid cleaning solutions of the present invention have a solution viscosity ranging from about 1 cps to about 3000 cps, more desirably, from about 100 cps to about 3000 cps. For liquid cleaning solutions containing one or more viscosity control agents, the liquid cleaning solutions desirably have a viscosity ranging from about 100 cps to about 500 cps.

III. Methods of Using the Liquid Cleaning Solutions

The liquid cleaning solutions of the present invention may be used in a variety of applications including, but not limited to, household, commercial and industrial applications. Suitable uses include, but are not limited to, as a hard surface cleaner such as a vehicle detergent/presoak/brightener, vehicle parts cleaner, enzymatic cleaner, surgical instruments, windows, dishes, floors, food processing plants, food contact areas, rust remover, and floor finish stripper; as an antimicrobial formulation for plants, animals, and hard surfaces; as a textile cleaner such as a detergent, bleach, presoak, sour, enzymatic cleaner, or sanitizer; as a water-treatment component; as a fruit and vegetable wash; and as an insecticide carrier. The liquid cleaning solutions of the present invention are particularly suitable for use as cleaners for cooking surfaces and cookware, such as grill surfaces and toasters, such as those commonly found in the fast food industry.

One desired method of using the liquid cleaning solution of the present invention is in the custom food service industry. In some cases, fast-food service companies desire a liquid cleaning system, which may be used at high temperatures, typically as high as 262.8° C. (505° F.). In one method of the present invention, a desired amount of liquid cleaning solution is poured or sprayed (or applied with a scrub pad or cloth, such as a heat-resistant, no-scratch pad) onto an outer surface of a cooking surface, such as a grill or toaster surface, while the cooking surface is at a temperature of up to about 262.8° C. (505° F.), and usually from about 93.3° C. (200° F.) to about 262.8° C. (505° F.). The liquid cleaning solution is allowed to spread across the outer surface to form an area of cleaning solution. Typically, the cleaning solution remains on the outer surface for a period of up to about 2 minutes, usually from about 1 to 2 minutes. A user may scrub the cooking surface, and then wipe the outer surface of the cooking apparatus with a damp cloth, removing substantially all of the liquid cleaning solution and particulate material removed from the outer cooking surface. This procedure may be repeated as needed.

In one embodiment of the present invention, a method of cleaning a cooking surface comprises applying a liquid cleaning solution onto an outer surface of a cooking apparatus, wherein the liquid cleaning solution comprises a composition as shown in Table 1 below.

TABLE 1

Exemplary Liquid Cleaning Solution Formulations

| Chemical Component | Desired Range (wt %) | More Desired Range (wt %) |
|---|---|---|
| water | up to ~50.0 | ~10.0 to ~25.0 |
| triethylene glycol | up to ~75.0 | ~50.0 to ~75.0 |
| glycerin | up to ~75.0 | ~50.0 to ~75.0 |
| potassium carbonate (47% solution) | up to ~40.0 | ~10.0 to ~30.0 |
| coconut-based soap solution (30%) | up to ~10.0 | ~0.5 to ~3.0 |
| xanthan gum thickener | up to ~2.0 | ~0.05 to ~1.0 |
| dye | up to ~1.0 | ~0.0001 to ~0.01 |

The liquid cleaning solution composition shown in Table 1 is particularly useful for cleaning cooking surfaces at temperatures of up to about 262.8° C. (505° F.), especially at temperatures of from about 93.3° C. (200° F.) to about 262.8° C. (505° F.). The liquid cleaning solution composition shown in Table 1 is desirably used as is without further dilution with water or other solvents.

In a further embodiment of the present invention, a method of cleaning a cooking surface comprises applying a liquid cleaning solution onto an outer surface of a cooking apparatus, wherein the liquid cleaning solution comprises a composition as shown in Table 2 below.

TABLE 2

Exemplary Liquid Cleaning Solution Formulations

| Chemical Component | Desired Range (wt %) | More Desired Range (wt %) |
|---|---|---|
| water | up to ~50.0 | ~12.0 to ~25.0 |
| triethylene glycol | up to ~35.0 | ~10.0 to ~20.0 |
| glycerin | up to ~65.0 | ~35.0 to ~45.0 |
| potassium carbonate (47% solution) | up to ~35.0 | ~10.0 to ~25.0 |
| coconut-based soap solution (30%) | up to ~15.0 | ~3.0 to ~9.0 |
| acrylic polymer thickener | up to ~10.0 | ~2.0 to ~6.0 |
| dye | up to ~1.0 | ~0.0001 to ~0.01 |

The liquid cleaning solution composition shown in Table 2 is particularly useful for cleaning cooking surfaces at temperatures of up to about 262.8° C. (505° F.), desirably, at temperatures of up to about 204.4° C. (400° F.), and especially at temperatures of from about 93.3° C. (200° F.) to about 204.4° C. (400° F.). The liquid cleaning solution composition shown in Table 2 is desirably used as is without further dilution with water or other solvents.

In other cases, fast-food service companies desire a liquid cleaning system, which may be used at room temperature, typically about 22.0° C. (72° F.). In one method of the present invention, a desired amount of liquid cleaning solution is poured or sprayed (or applied with a scrub pad or cloth, such as a no-scratch pad) onto an outer surface of a cooking surface at room temperature. The liquid cleaning solution is allowed to spread across the outer surface to form an area of cleaning solution. Typically, the cleaning solution remains on the outer surface for a period of up to 24 hours, usually from about 1 minute to about 8 hours. For example, a piece of cookware or any other surface to be cleaned may soak in the liquid cleaning solution overnight. In some cases, the liquid cleaning solution may be removed immediately after applying to the surface. A user may scrub, and then wipe the outer surface of the cooking apparatus with a damp cloth, removing substantially all of the liquid cleaning solution and particulate material removed from the outer cooking surface. This procedure may be repeated as needed. In addition, a separate rinse step may be used to remove any remaining liquid cleaning solution and/or particulate material from the outer cooking surface if necessary or desired.

One exemplary method of cleaning a cooking surface at room temperature comprises applying a liquid cleaning solution onto an outer surface of a cooking apparatus, wherein the liquid cleaning solution comprises a composition as shown in Table 3 below.

TABLE 3

Exemplary Liquid Cleaning Solution Formulations

| Chemical Component | Desired Range (wt %) | More Desired Range (wt %) |
|---|---|---|
| water | up to ~80.0 | ~40.0 to ~60.0 |
| ethoxylated alcohol having $C_{13}$–$C_{15}$ moieties and 7 ethoxylate groups | up to ~20.0 | ~11.0 to ~17.0 |
| ethoxylated alcohol having $C_{12}$–$C_{14}$ moieties and 3 ethoxylate groups | up to ~10.0 | ~1.0 to ~5.0 |
| propoxylated cationic ammonium surfactant | up to ~10.0 | ~4.0 to ~10.0 |
| sodium iminodisuccinate | up to ~60.0 | ~20.0 to ~30.0 |
| preservative | up to ~2.0 | ~0.003 to ~0.008 |
| dye | up to ~2.0 | ~0.0001 to ~0.0015 |
| perfume | up to ~2.0 | ~0.05 to ~0.5 |
| foam control agent | up to ~2.0 | ~0.10 to ~0.5 |

The liquid cleaning solution compositions shown in Table 3 may be used at temperatures up to about 262.8° C. (505° F.); however, the liquid cleaning solution compositions shown in Table 3 have exceptional cleaning capacity for cleaning cooking surfaces at room temperature, and are desirably used at room temperature.

The liquid cleaning solution compositions shown in Table 3 may be used as is or diluted with a solvent. When diluted, the solvent is desirably water. Useful dilution concentrations of the cleaning compositions may range from about 0.01 to about 50 wt %, desirably from about 0.1 to about 25 wt %, and more desirably from about 0.5 to about 10 wt %. The use dilutions may be in the form of a solution, unit dose, liquid crystal, water-in-oil emulsion, oil-in-water emulsion, dispersion, microemulsion, or gel. These use dilutions may be applied as a liquid, foam, paste, or gel.

The present invention is further illustrated by the following examples, which are not to be construed in any way as imposing limitations upon the scope thereof. On the contrary, it is to be clearly understood that resort may be had to various other embodiments, modifications, and equivalents thereof, which, after reading the description herein, may suggest themselves to those skilled in the art without departing from the spirit of the present invention and/or the scope of the appended claims.

EXAMPLES

The materials shown in Table 4 are used in the examples below.

TABLE 4

Chemicals Used In Examples

| Material | Description | Manufacturer |
|---|---|---|
| Surfactants | | |
| coconut-based soap solution (30%) | coconut-based soap having 30% solids | Kay Chemical Company Greensboro, NC |
| SURFONIC ® 24-3 | ethoxylated alcohol having $C_{12}$–$C_{14}$ moieties and 3 ethoxylate groups | Huntsman Corp. Houston, TX |
| TERGITOL ™ 15-S-7 | ethoxylated alcohol having $C_{13}$–$C_{15}$ moieties and 7 ethoxylate groups | Dow Chemical Company Midland, MI |
| GLENSURF ™ 42 | propoxylated cationic ammonium surfactant | Glenn Chemical Company St. Paul, MN |
| Builders | | |
| BAYPURE ® CX100 | sodium iminodisuccinate | Bayer Chemical Baytown, TX |
| Solvents | | |
| TEG | triethylene glycol | Equistar Dallas, TX |
| glycerin | glycerin (99.5%) | Lonza, Inc. Fairlawn, TX |
| pH Control Agents | | |
| potassium carbonate | potassium carbonate (47% solution) | Ashta Chemical Ashtabula, OH |
| Viscosity Control Agents | | |
| ACUSOL ® 820 | acrylic polymer | Rohm & Haas, Glen Allen, VA |
| KELTROL ™ | xanthan gum thickener | CP Kelco Wilmington, DE |
| KELTROL ™ HP | xanthan gum thickener | CP Kelco Wilmington, DE |
| Colorants | | |
| Yellow Dye FD&C#5 | dye | Pylam Products, Co. Tempe, AZ |

Example 1

Preparation of a Liquid Cleaning Solution

A liquid cleaning solution was prepared having the formulation as shown in Table 5 below and a total solution weight of 100 kilograms (kg.).

TABLE 5

Liquid Cleaning Solution

| Chemical Name | Chemical Component | Net. Wt. | Wt % |
|---|---|---|---|
| Water | water, city of Greensboro, NC | 63.875 kg | 63.875 |
| glycerin | glycerin (99.5%) | 14.9847 kg | 14.9847 |
| potassium carbonate | potassium carbonate (47% solution) | 20.000 kg | 20.000 |
| coconut-based soap solution (30%) | coconut-based soap solution (30%) | 1.000 kg | 1.000 |
| KELTROL ™ HP | xanthan gum thickener | 125 g | 0.125 |
| Yellow Dye FD&C#5 | dye | 0.11 g | 0.00011 |

The resulting composition had a viscosity of about 200 cps at room temperature, 25° C. (77° F.).

About 19 grams of the liquid was applied as is to a cooking surface of a sandwich grill from DOUGHPRO Proprocess Corp., Paramount, Calif. The cooking surface had a surface temperature of up to 262.8° C. (505° F.). The cleaning solution was allowed to stand on the cooking surface for up to 2 minutes. The liquid cleaning solution did not splatter or generate smoke.

The cooking surface was wiped to completely remove the cleaning solution from the cooking surface using a damp cloth. The cooking solution removed 100% of the cooked-on food and grease from the cooking surface of the sandwich grill without leaving a residue.

Comparative Example 1

The liquid cleaning solution of Example 1 was compared to five commercially available cleaners. The cleaners were evaluated for viscosity, spread rate (i.e., the outer diameter of a 14.8 ml. (0.5 oz.) sample of cleaning solution after 90 seconds on a cooking surface at 262.8° C. (505° F.)), generation of residue, generation of smoke, splattering, and percent removal of carbonized soil from the cooking surface. The results of the comparison are given in Table 6 below.

TABLE 6

Comparative Testing Results of Liquid Cleaning Solutions

| | Liquid Property | | | | | |
|---|---|---|---|---|---|---|
| Sample | Viscosity (cps) at 25° C. | Spread Rate at 262.8° C. | Residue at 262.8° C. | Smoke at 262.8° C. | Splattering at 262.8° C. | % Carbonized Removal |
| Example 1 Liquid | 200 | 6 inches | 0 | 0 | 0 | 100% |

TABLE 6-continued

| | | | | | | |
|---|---|---|---|---|---|---|
| Commercial Product 1 | 43 | 8 inches | 0 | 3 | 2 | 100% |
| Commercial Product 2 | 21 | 10 inches | 3 | 4 | 3 | 100% |
| Commercial Product 3 | 12 | 13.25 inches (width of grill) | 3 | 4 | 4 | 95% |
| Commercial Product 4 | 1050 | 6.5 inches | 4 | 0 | 0 | 100% |
| Commercial Product 5 | 93 | 7 inches | 2 | 3 | 3 | 100% |

| Residue Scale | Smoke Scale | Splattering Scale |
|---|---|---|
| 0 = None | 0 = None | 0 = None |
| 1 = Light | 1 = Some | 1 = Some |
| 2 = medium | 2 = Moderate | 2 = Moderate |
| 3 = Heavy | 3 = Heavy | 3 = Heavy |
| 4 = Very Heavy | 4 = Very Heavy | 4 = Very Heavy |

A scale from 0 to 4 was used to rate the generation of residue, generation of smoke, and splattering of each liquid cleaning solution. As shown above, the liquid cleaning solution of Example 1 was the only liquid cleaning solution having a rating of "0" for each of generation of residue, generation of smoke, and splattering, while still providing exceptional removal of carbonized soil from the cooking surface.

Example 2

Preparation of a Liquid Cleaning Solution

A liquid cleaning solution was prepared having the formulation as shown in Table 7 below and a total solution weight of 100 kilograms (kg.).

TABLE 7

Liquid Cleaning Solution

| Chemical Name | Chemical Component | Net. Wt. | Wt % |
|---|---|---|---|
| Water | water, city of Greensboro, NC | 21.0 kg | 21.0 |
| glycerin | glycerin (99.5%) | 40.0 kg | 40.0 |
| TEG | triethylene glycol | 15.0 kg | 15.0 |
| potassium carbonate | potassium carbonate (47% solution) | 15.0 kg | 15.0 |
| coconut-based soap solution (30%) | coconut-based soap solution (30%) | 5.0 kg | 5.0 |
| ACUSOL ® 820 | acrylic polymer thickener | 4.0 kg | 4.0 |
| Yellow Dye FD&C#5 | dye | 0.11 g | 0.00011 |

The resulting composition had a viscosity of about 230 cps at room temperature, 25° C. (77° F.).

About 30 ml. of the liquid was applied as is onto a cooking surface of a sandwich grill as described in Example 1. The cooking surface had a surface temperature of about 135° C. (275° F). The cleaning solution was allowed to stand on the cooking surface for about 2 minutes. The liquid cleaning solution did not scatter or generate smoke.

The cleaning solution was wiped from the cooking surface using a damp cloth. The cooking solution removed 100% of the cooked-on food and grease from the cooking surface of the sandwich grill without leaving a residue.

Example 3

Preparation of a Liquid Cleaning Solution

A liquid cleaning solution was prepared having the formulation as shown in Table 8 below and a total solution weight of 100 kilograms (kg.).

TABLE 8

Liquid Cleaning Solution

| Chemical Name | Chemical Component | Net. Wt. | Wt % |
|---|---|---|---|
| Water | water, city of Greensboro, NC | 15.0 kg | 15.0 |
| glycerin | glycerin (99.5%) | 40.0 kg | 40.0 |
| TEG | triethylene glycol | 15.0 kg | 15.0 |
| potassium carbonate | potassium carbonate (47% solution) | 20.0 kg | 20.0 |
| coconut-based soap solution (30%) | coconut-based soap solution (30%) | 5.0 kg | 5.0 |
| ACUSOL ® 820 | acrylic polymer thickener | 5.0 kg | 5.0 |
| Yellow Dye FD&C#5 | dye | 0.11 g | 0.00011 |

The resulting composition had a viscosity of about 220 cps at room temperature, 25° C. (77° F.).

About 30 ml. of the liquid was applied as is to a cooking surface of a sandwich grill as described in Example 1. The cooking surface had a surface temperature of about 135° C. (275° F.). The cleaning solution was allowed to stand on the cooking surface for about 2 minutes. The liquid cleaning solution did not scatter or generate smoke.

The cleaning solution was wiped from the cooking surface using a damp cloth. The cooking solution removed 100% of the cooked-on food and grease from the cooking surface of the sandwich grill without leaving a residue.

Example 4

Preparation of a Liquid Cleaning Solution

A liquid cleaning solution was prepared having the formulation as shown in Table 9 below and a total solution weight of 100 kilograms (kg.).

TABLE 9

Liquid Cleaning Solution

| Chemical Name | Chemical Component | Net. Wt. | Wt % |
|---|---|---|---|
| Water | water, city of Greensboro, NC | 50.75 kg | 50.75 |
| TERGITOL ™ 15-S-7 | ethoxylated alcohol having $C_{13}$–$C_{15}$ moieties and 7 ethoxylate groups | 14.33 kg | 14.33 |
| SURFONIC ® 24-3 | ethoxylated alcohol having $C_{12}$–$C_{14}$ moieties and 3 ethoxylate groups | 2.99 kg | 2.99 |
| GLENSURF ™ 42 | propoxylated quat | 6.57 kg | 6.57 |
| BAYPURE ® CX100 | sodium iminodisuccinate | 25.37 kg | 25.37 |

The resulting composition was diluted with additional water at a dilution ratio of 1 part composition of Table 9 to 99 parts of water.

About 19 grams of the diluted use liquid was sprayed onto a cooking surface of a sandwich grill as described in Example 1. The cooking surface had a surface temperature of about 22° C. (72° F.). The cleaning solution was allowed to stand on the cooking surface for about 90 seconds.

The use cleaning solution was wiped from the cooking surface using a damp cloth. The cooking solution removed 100% of the cooked-on food and grease from the cooking surface of the sandwich grill without leaving a residue.

While the specification has been described in detail with respect to specific embodiments thereof, it will be appreciated that those skilled in the art, upon attaining an understanding of the foregoing, may readily conceive of alterations to, variations of, and equivalents to these embodiments. Accordingly, the scope of the present invention should be assessed as that of the appended claims and any equivalents thereto.

What is claimed is:

1. A liquid cleaning solution comprising:

(a) from greater than 0 to about 70 percent by weight water;

(b) from greater than 0 to about 10.0 percent by weight of a coconut-based soap solution;

(c) from greater than 0 to about 75.0 percent by weight of triethylene glycol, glycerin, or a combination thereof;

(d) at least one material selected from the group consisting of xanthan gum thickener, acrylic polymer thickener, and sodium iminodisuccinate; and (e) from greater than 0 to about 40.0 percent by weight of a solution of potassium carbonate in water;

wherein all percents by weight are based on a total weight of the liquid cleaning solution.

2. The liquid cleaning solution of claim 1, wherein the liquid cleaning solution further comprises at least one pH control agent in an amount to provide a liquid cleaning solution pH of from about 8.0 to about 13.0.

3. The liquid cleaning solution of claim 1, wherein the liquid cleaning solution further comprises one or more additives selected from a dye, a perfume, a preservative, a foam control agent, and combinations thereof.

4. The liquid cleaning solution of claim 1, wherein the liquid cleaning solution comprises:

(a) from about 12.0 to about 25.0 percent by weight of water;

(b) from about 50.0 to about 65.0 percent by weight of triethylene glycol, glycerin, or a combination thereof;

(c) from about 10.0 to about 25.0 percent by weight of a solution of potassium carbonate in water having 47 percent by weight of potassium carbonate; and (d) from about 0.5 about 6.0 percent by weight of a coconut-based soap solution; wherein all percents by weight are based on a total weight of the liquid cleaning solution.

5. The liquid cleaning solution of claim 4, wherein the liquid cleaning solution further comprises xanthan thickener in an amount of up to about 2.0 percent by weight, based on a total weight of the liquid cleaning solution.

6. The liquid cleaning solution of claim 5, wherein the liquid cleaning solution comprises:

(a) about 15.0 percent by weight of water;

(b) about 64.0 percent by weight of glycerin;

(c) about 20.0 percent by weight of a solution of potassium carbonate in water having 47 percent by weight of potassium carbonate;

(d) about 1.0 percent by weight of a coconut-based soap solution; and (e) about 0.125 percent by weight of a xanthan gum thickener; wherein all percents by weight are based on a total weight of the liquid cleaning solution.

7. The liquid cleaning solution of claim 4, wherein the liquid cleaning solution further comprises an acrylic polymer thickener in an amount of up to about 5.0 percent by weight, based on a total weight of the liquid cleaning solution.

8. The liquid cleaning solution of claim 7, wherein the liquid cleaning solution comprises:

(a) about 21.0 percent by weight of water;

(b) about 40.0 percent by weight of glycerin;

(c) about 15.0 percent by weight of triethylene glycol;

(d) about 15.0 percent by weight of a solution of potassium carbonate in water having 47 percent by weight of potassium carbonate;

(e) about 5.0 percent by weight of a coconut-based soap solution; and (f) about 4.0 percent by weight of an acrylic polymer thickener; wherein all percents by weight are based on a total weight of the liquid cleaning solution.

9. The liquid cleaning solution of claim 7, wherein the liquid cleaning solution comprises:

(a) about 15.0 percent by weight of water;

(b) about 40.0 percent by weight of glycerin;

(c) about 15.0 percent by weight of triethylene glycol;

(d) about 20.0 percent by weight of a solution of potassium carbonate in water having 47 percent by weight of potassium carbonate;

(e) about 5.0 percent by weight of a coconut-based soap solution; and (f) about 5.0 percent by weight of an acrylic polymer thickener; wherein all percents by weight are based on a total weight of the liquid cleaning solution.

10. A cleaning solution comprising:

(a) from greater than 0 to about 70.0 percent by weight of water;

(b) from greater than 0 to about 25.0 percent by weight of an ethoxylated alcohol having $C_{13-15}$ moieties and about 7 ethoxylate groups;

(c) from greater than 0 to about 6.0 percent by weight of an ethoxylated alcohol having $C_{12-14}$ moieties and about 3 ethoxylate groups;

(d) from greater than 0 to about 10.0 percent by weight of a propoxylated cationic ammonium compound;

(e) up to 95 percent by weight of one or more solvents other than water, and (f) at least one material selected from the group consisting of xanthan urn thickener, acrylic polymer thickener, and sodium iminodisuccinate; wherein all percents by weight are based on a total weight of the liquid cleaning solution.

11. The liquid cleaning solution of claim 10, wherein the liquid cleaning solution comprises:

(a) from about 40.0 to about 60.0 percent by weight of water;

(b) from about 11.0 to about 17.0 percent by weight of an ethoxylated alcohol having $C_{13-15}$ moieties and about 7 ethoxylate groups;

(c) from about 1.0 about 5.0 percent by weight of an ethoxylated alcohol having $C_{12-15}$ moieties and about 3 ethoxylate groups;

(d) from about 4.0 to about 10.0 percent by weight of a propoxylated cationic ammonium compound; and (e) from about 20.0 to about 30.0 percent by weight of sodium iminodisuccinate; wherein all percents by weight are based on a total weight of the liquid cleaning solution.

12. The liquid cleaning solution of claim 11, wherein the liquid cleaning solution comprises:

(a) about 50.7 percent by weight of water;

(b) about 14.3 percent by weight of an ethoxylated alcohol having $C_{13-15}$ moieties and about 7 ethoxylate groups;

(c) about 3.0 percent by weight of an ethoxylated alcohol having $C_{12-14}$ moieties and about 3 ethoxylate groups;

(d) about 6.6 percent by weight of a propoxylated cationic ammonium compound; and (e) about 25.4 percent by weight of sodium iminodisuccinate; wherein all percents by weight are based on a total weight of the liquid cleaning solution.

13. A use solution comprising from about 1 to 100 parts of the liquid cleaning solution of claim 11 per about 100 parts of at least one dilution solvent.

14. The use solution of claim 13, wherein the at least one dilution solvent comprises water.

15. The liquid cleaning solution of claim 1, wherein the liquid cleaning solution (i) is stable for at least 120 seconds at a temperature of up to about 262.8° C. (505° F.); (ii) is substantially free of splattering at temperatures of up to about 262.8° C. (505° F.); (iii) is substantially free of smoke at temperatures of up to about 262.8° C. (505° F.); and (iv) is substantially free of residue at temperatures up to about 262.8° C. (505° F.).

16. The liquid cleaning solution of claim 10, wherein the liquid cleaning solution cleans cooking surfaces at room temperature (22° C., 72° F.).

17. A method of cleaning a cooking surface having a surface temperature of up to about 262.8° C. (505° F.), wherein the method comprises:

(i) covering at least a portion of the cooking surface with a liquid cleaning solution, wherein the liquid cleaning solution comprises:

(a) from greater than 0 to about 70 percent by weight water;

(b) from greater than 0 to about 10.0 percent by weight of a coconut-based soap solution;

(c) from greater than 0 to 75.0 percent in by weight of triethylene glycol, glycerin, or a combination thereof;

(d) at least one material selected from the group consisting of xanthan gum thickener, acrylic polymer thickener, and sodium iminodisuccinate; and (e) from greater than 0 to about 40.0 percent by weight of a solution of potassium carbonate in water: wherein all percents by weight are based on a total weight of the liquid cleaning solution;

(ii) letting the liquid cleaning solution remain on the cooking surface for at least one second; and (iii) removing the liquid cleaning solution from the cooking surface.

18. The method of claim 17, wherein the liquid cleaning solution comprises:

(a) about 15.0 percent by weight of water;

(b) about 64.0 percent by weight of glycerin;

(c) about 20.0 percent by weight of a solution of potassium carbonate in water having 47 percent by weight of potassium carbonate;

(d) about 1.0 percent by weight of a coconut-based soap solution; and (e) about 0.125 percent by weight of a xanthan gum thickener; wherein all percents by weight are based on a total weight of the liquid cleaning solution.

19. The method of claim 17, wherein the liquid cleaning solution comprises:

(a) about 21.0 percent by weight of water;

(b) about 40.0 percent by weight of glycerin;

(c) about 15.0 percent by weight of triethylene glycol;

(d) about 15.0 percent by weight of a solution of potassium carbonate in water having 47 percent by weight of potassium carbonate;

(e) about 5.0 percent by weight of a coconut-based soap solution; and (f) about 4.0 percent by weight of an acrylic polymer thickener; wherein all percents by weight are based on a total weight of the liquid cleaning solution.

20. The method of claim 17, wherein the liquid cleaning solution comprises:

(a) about 15.0 percent by weight of water;

(b) about 40.0 percent by weight of glycerin;

(c) about 15.0 percent by weight of triethylene glycol;

(d) about 20.0 percent by weight of a solution of potassium carbonate in water having 47 percent by weight of potassium carbonate;

(e) about 5.0 percent by weight of a coconut-based soap solution; and (f) about 5.0 percent by weight of an acrylic polymer thickener; wherein all percents by weight are based on a total weight of the liquid cleaning solution.

21. A method of cleaning a cooking surface having a surface temperature of up to about 262.8° C. (505° F.), wherein the method comprises:

(i) covering at least a portion of the cooking surface with a liquid cleaning solution, wherein the liquid cleaning solution comprises:

(a) from greater than 0 to about 70.0 percent by weight of water;

(b) from greater than 0 to about 25.0 percent by weight of an ethoxylated alcohol having $C_{13-15}$ moieties and about 7 ethoxylate groups;

(c) from greater than 0 to about 6.0 percent by weight of an ethoxylated alcohol having $C_{13-14}$ moieties and about 3 ethoxylate groups;

(d) from greater than 0 to about 10.0 percent by weight of a propoxylated cationic ammonium compound;

(e) up to 95 percent by weight of one or more solvents other than water; and (f) at least one material selected from the group consisting of xanthan gum thickener, acrylic polymer thickener, and sodium iminodisuccinate;

wherein all percents by weight are based on a total weight of the liquid cleaning solution;

(ii) letting the liquid cleaning solution remain on the cooking surface for at least one second; and (iii) removing the liquid cleaning solution from the cooking surface.

22. The method of claim 17, wherein the liquid cleaning solution is applied onto a cooking surface having a surface temperature up to about 148.9° C. (300° F.).

23. The method of claim 17, wherein the liquid cleaning solution is applied onto a cooking surface having a surface temperature up to about 22° C. (72° F.).

24. The method of claim 17, wherein the cooking surface is a portion of a grill or toaster.

25. The method of claim 21, wherein the cooking surface is a portion of a grill or toaster.

26. The method of claim 21, wherein the liquid cleaning solution is applied onto a cooking surface having a surface temperature up to about 148.9° C. (300° F.).

27. The method of claim 21, wherein the liquid cleaning solution is applied onto a cooking surface having a surface temperature up to about 22° C. (72° F.).

* * * * *

UNITED STATES PATENT AND TRADEMARK OFFICE

CERTIFICATE OF CORRECTION

PATENT NO. : 7,056,874 B2
APPLICATION NO. : 10/659806
DATED : June 6, 2006
INVENTOR(S) : Tami J. Tadrowski et al.

It is certified that error appears in the above-identified patent and that said Letters Patent is hereby corrected as shown below:

Col. 16, Line 11, "liquid cleaning solution further comprises xanthan thickener" should be --liquid cleaning solution further comprises xanthan gum thickener--

Col. 16, Line 57, "10. A cleaning solution comprising:" should be --10. A liquid cleaning solution comprising:--

Col. 17, Line 4, "of xanthan urn thickener, acrylic polymer thickener," should be --of xanthan gum thickener, acrylic polymer thickener--

Col. 17, Line 16, "ethoxylated alcohol having $C_{12-15}$ moieties and about 3" should be --ethoxylated alcohol having $C_{12-14}$ moieties and about 3--

Col. 17, Line 62, "(c) from greater than 0 to 75.0 percent in by weight of" should be --(c) from greater than 0 to 75.0 percent by weight of--

Col. 18, Line 59, "of an ethoxylated alcohol having $C_{13-14}$ moieties and" should be --of an ethoxylated alcohol having $C_{12-14}$ moieties and--

Signed and Sealed this

Seventh Day of August, 2007

JON W. DUDAS
*Director of the United States Patent and Trademark Office*